US007344764B2

(12) United States Patent
Tsukada et al.

(10) Patent No.: US 7,344,764 B2
(45) Date of Patent: Mar. 18, 2008

(54) THERMAL TRANSFER RECEIVING SHEET

(75) Inventors: Chikara Tsukada, Yokohama (JP); Masato Kawamura, Yokohama (JP); Hideaki Shinohara, Nishitokyo (JP)

(73) Assignee: OJI Paper Co., Ltd., Tokyo (JP)

( * ) Notice: Subject to any disclaimer, the term of this patent is extended or adjusted under 35 U.S.C. 154(b) by 121 days.

(21) Appl. No.: 10/547,705

(22) PCT Filed: Mar. 3, 2004

(86) PCT No.: PCT/JP2004/002626

§ 371 (c)(1),
(2), (4) Date: Sep. 2, 2005

(87) PCT Pub. No.: WO2004/078480

PCT Pub. Date: Sep. 16, 2004

(65) Prior Publication Data

US 2006/0194003 A1 Aug. 31, 2006

(30) Foreign Application Priority Data

Mar. 3, 2003 (JP) ..... 2003-055772
Nov. 14, 2003 (JP) ..... 2003-385275

(51) Int. Cl.
*B41M 5/40* (2006.01)

(52) U.S. Cl. ..... 428/32.5; 428/32.25; 428/32.37; 428/32.39; 428/323; 428/324; 503/227

(58) Field of Classification Search ..... 428/32.39, 428/32.5, 32.25, 32.37, 323, 324; 503/227
See application file for complete search history.

(56) References Cited

U.S. PATENT DOCUMENTS

| | | | | |
|---|---|---|---|---|
| 4,806,421 | A * | 2/1989 | Morishita et al. | 428/324 |
| 2001/0004485 | A1* | 6/2001 | Takahashi et al. | 428/195 |
| 2002/0041951 | A1* | 4/2002 | Shirai et al. | 428/195 |
| 2002/0151438 | A1* | 10/2002 | Mihara et al. | 503/227 |
| 2003/0039930 | A1* | 2/2003 | Aylward et al. | 430/496 |

FOREIGN PATENT DOCUMENTS

| | | |
|---|---|---|
| JP | 1-198388 | 8/1989 |
| JP | 1-221282 | 9/1989 |
| JP | 2-286290 | 11/1990 |
| JP | 6-227159 | 8/1994 |
| JP | 7-228063 | 8/1995 |
| JP | 2003-63152 | 3/2003 |

* cited by examiner

*Primary Examiner*—Milton I. Cano
*Assistant Examiner*—David J. Joy
(74) *Attorney, Agent, or Firm*—Edwards Angell Palmer & Dodge LLP

(57) ABSTRACT

There is provided a thermal transfer receiving sheet comprising a substrate, a barrier layer laminated on said substrate, and an image receiving layer laminated on said barrier layer, wherein said barrier layer and said image receiving layer are laminated on at least one side of said substrate, characterized in that the major components of said barrier layer are a swellable lamellar inorganic component and an adhesive, wherein said swellable lamellar inorganic component has a mean particle diameter of at least 0.1 μm and not greater than 100 μm, and an aspect ratio (ratio of mean particle diameter to thickness of the lamellar composite) of at least 100 and not greater than 5000.

16 Claims, No Drawings

THERMAL TRANSFER RECEIVING SHEET

FIELD OF THE INVENTION

The present invention relates to a thermal transfer receiving sheet. More specifically, it relates to a thermal transfer receiving sheet (hereinafter also referred to simply as "receiving sheet") which has a high image quality and a high image stability, as well as an excellent anti-curl property during printing, and which is also inexpensive.

BACKGROUND ART

In recent years, there has been an increased interest in thermal printers and, especially, in dye thermal transfer printers which allow printing of clear full-color images. A dye thermal transfer printer forms an image by placing a dye-containing layer of the ink sheet onto an image-receiving layer (hereinafter also referred to simply as "receiving layer") comprising a dye-fixable resin on the receiving sheet, and then supplying heat from a thermal head or the like so as to transfer the dye at a predetermined location of the dye layer of the ink sheet to the receiving layer. The ink sheets comprise dye layers of three colors: yellow, magenta and cyan, or four colors, if black is also included. A full-color image is obtained by repeatedly transferring the dye of each of the colors in sequence to the receiving sheet. Because dye thermal transfer systems allow high-quality image recording, and are also suitable for digital printing from recently popular digital cameras, such systems are gradually replacing silver salt photography.

The receiving sheet is associated with a drawback of a poor image stability, because the dyes transferred to the receiving layer penetrate into the underlying layer over time, and are then diffused into the substrate (hereinafter also referred to as "bleeding"), whereby the image would lose clarity.

This drawback becomes particularly pronounced when it is attempted to improve the recorded image density or quality by forming an intermediate layer comprising hollow or foam particles on a base sheet so as to impart a cushioning property to the receiving sheet (for example, Japanese Unexamined Patent Publication (Kokai) No. 1-27996, Japanese Unexamined Patent Publication (Kokai) No. 63-87286).

The thermal insulation property, smoothness and cushioning property are essential features for efficient utilization of heat from the thermal head for printing, and they significantly affect the printed image quality and image density. More specifically, in the course of printing an image, the receiving sheet contacts with the thermal head via the ink sheet and is pressed from the opposite side by a rubber roll which is referred to as a "platen roll". Under the pressure applied from the rubber roll, a receiving sheet with a good cushioning property will adhere completely to the ink sheet, with an absence of gaps, and allow uniform transfer of the ink for satisfactory image quality, but a receiving sheet with a poor cushioning property will adhere to the ink sheet with gaps between it and the contacting ink sheet, whereby the ink will be poorly transferred, due to the existence of gaps, resulting in a non-uniform image. Thus, the cushion property is one of the most important qualities of a receiving sheet. Japanese Unexamined Patent Publication (Kokai) No. 9-99651 discloses the preferred sizes for hollow particles in the intermediate layer (foam layer), for the purpose of achieving an enhanced printing quality.

A receiving sheet fabricated by providing an intermediate layer containing hollow or foam particles has a drawback of a significantly poor image stability, because the dyes transferred to the receiving layer penetrate into the underlying layer over time and, then, tend to be diffused into the substrate (bleeding), whereby the image would lose clarity. Thus, a layer with high barrier properties (a barrier layer) is essential in order to prevent bleeding particularly in receiving sheets having an intermediate layer comprising hollow or foam particles.

Japanese Unexamined Patent Publication (Kokai) No. 6-227159 proposes a method wherein a layer containing a lamellar inorganic pigment with an aspect ratio of 5-90 is provided on a hollow particle containing primer coating layer (intermediate layer), for the purpose of preventing penetration of the receiving layer coating components or the solvent used in the receiving layer coating composition. However, a layer containing such a lamellar inorganic pigment having an aspect ratio in the aforementioned range is not sufficient to prevent penetration of the image-forming dye into the intermediate layer or substrate, and thus exhibits virtually no bleed-preventing effects. One of the reasons for this is presumably that, unlike the penetration of the receiving layer coating components or the solvent used in the receiving layer coating composition, with respect to a dye used in sublimation thermal transfer, penetration of the dye occurs at a molecular level. Bleeding may be prevented by increasing the coverage of the barrier layer. However, excessive increase of the coverage of the barrier layer will reduce the thermal insulating effect of the intermediate layer, whereby reduces the printing density, and thus, results in unclear images. With ongoing substitution for silver salt photography in recent years, a demand exists for receiving sheets with higher image quality and a superior image stability, goals which require better techniques.

DISCLOSURE OF THE INVENTION

The present invention has been accomplished in light of the aforementioned circumstances, and its object is to provide a thermal transfer receiving sheet which has high image quality and high image stability, without bleeding of the printed images over time, and which is also inexpensive while exhibiting an excellent anti-curl property during printing.

As a result of much diligent research into the problems described above, the present inventors have solved all of the problems mentioned above by providing a thermal transfer receiving sheet comprising a substrate, a barrier layer laminated on said substrate, and an image receiving layer laminated on said barrier layer, wherein said barrier layer and said image receiving layer are laminated on at least one side of said substrate, characterized in that the major components of said barrier layer are a swellable lamellar inorganic component and an adhesive, wherein said swellable lamellar inorganic component has a mean particle diameter of at least 0.1 μm and not greater than 100 μm, and an aspect ratio (ratio of mean particle diameter/thickness of the lamellar composite) of at least 100 and not greater than 5000.

According to a preferred embodiment, the thermal transfer receiving sheet further comprises a hollow particle-containing intermediate layer laminated between the barrier layer and the substrate. The mean particle size of the hollow particles is preferably at least 0.1 μm and not greater than 20 μm and, in the barrier layer, an aqueous polymer compound is preferably used as the adhesive, while the aqueous polymer compound is preferably at least one selected from the group consisting of polyvinyl alcohol, ethylene-vinyl alcohol copolymer resins and ethylene-acrylic acid copolymer resins.

The thermal transfer receiving sheet may also have an adhesive layer on the side of the substrate opposite the image receiving layer side, and may also have a release sheet having a release coating containing a release agent on said adhesive layer, wherein said release sheet is laminated on the adhesive layer by its release coating side.

The receiving sheet of the present invention is an ultra-high-quality receiving sheet which produces high quality images, has high image stability without bleeding of printed images over time, and is inexpensive while exhibiting an excellent anti-curl property during printing. Thus, the present receiving sheet is highly valuable.

BEST MODE FOR CARRYING OUT THE INVENTION

The present invention will now be described in greater detail.

The present inventors explored various barrier layer materials with the aim of overcoming the aforementioned problem of bleeding of thermal transfer dye images. Polyvinyl alcohol and acrylic copolymer resins can form films on intermediate layers, but when a printing sheet having such a film formed thereon is placed in a wallet or in a clothing pocket for long periods, or when it is wetted by outdoor rain, the image suffers a notable degree of bleeding. That is, the resin mentioned above does not exhibit an adequate barrier property under highly humid conditions or when being directly exposed to water, and therefore cannot prevent bleeding. Highly-crosslinked urethane resins are also known which generally have a high barrier property, but when it is attempted to apply these as a barrier layer of the present invention, film formation on the intermediate layer will become difficult and, thus, an adequate barrier property cannot be exhibited. While film formation can be achieved by a considerable increase of the coverage, and bleeding of images can thus be reduced, the hardness of urethane resins also reduces the cushioning property and impairs the image quality and, in severe cases, leads to cracking of the layer and a notably poor outer appearance. Urethane resins are also expensive, and therefore disadvantageous in economic terms. The inventors therefore searched for a method which solves the problem of bleeding by means of a lamellar pigment. As a result of much diligent research, it was discovered that a remarkable bleeding prevention effect is exhibited by adding a swellable lamellar inorganic component to the barrier layer. This is due to the exceedingly high crystallinity of the swellable lamellar inorganic component which does not permit passage of the thermal transfer dye. Accordingly, by laying the swellable lamellar inorganic components in parallel on the intermediate layer to form multiple laminated layers, while at the same time, by adhering the swellable lamellar inorganic components to each other and also to the intermediate layer by means of a polymer compound, a notable bleed-preventing effect was obtained.

As specific examples of swellable lamellar inorganic components, there may be mentioned graphite, phosphate-based derivative-type compounds (such as zirconium phosphate-based compounds), chalcogen compounds, hydrotalcite compounds, lithium-aluminum complex hydroxides, clay-based minerals (for example, synthetic mica and synthetic smectite), and the like.

Graphite, phosphate-based inductor-type compounds (such as zirconium phosphate-based compounds), chalcogen compounds, hydrotalcite compounds and lithium-aluminum complex hydroxides are compounds or substances with lamellar structures formed by unit crystal layers stacked on each other, where a lamellar structure is defined as a structure wherein planes, each having atoms strongly bonded with each other by covalent bonds and densely arranged therein, are stacked roughly in parallel by weak bonding forces such as Van der Waals forces.

A "chalcogen compound" is a dichalcogen compound of a Group IV (Ti, Zr, Hf), Group V (V, Nb, Ta) and/or Group VI (Mo, W) element, and it is represented by the formula $MX_2$ (wherein M is the aforementioned element and X is a chalcogen (S, Se, Te)).

Clay-based minerals are generally categorized into a type with a bilayer structure having an octahedral layer comprising aluminum, magnesium or the like as the central metal on a tetrahedral layer of silica, and a type with a trilayer structure wherein a tetrahedral layer of silica is sandwiched between two octahedral layers comprising magnesium or the like as the central metal. As the former bilayer structure type, there may be mentioned kaolinite and antigorite, and as the latter trilayer structure type, depending on the number of interlayer cations, there may be mentioned smectite, vermiculite and mica.

As specific clay-based minerals there may be mentioned kaolinite, dickite, nacrite, halloysite, antigorite, chrysotile, pyroferrite, montmorillonite, hectorite, tetrasilicic mica, sodium taeniolite, margarite, talc, vermiculite, xanthophyllite, chlorite and the like. Other examples may be found in the publication, "Nendo Kobutsugaku" [Clay Mineralogy] by Haruo Shiromizu, 1988, Asakura Shoten.

Preferably used among clay-based minerals as swellable lamellar inorganic components of the present invention are minerals of the smectite, vermiculite and mica families. More preferred from among the smectite family are, for example, montmorillonite, beidellite, nontronite, saponite, iron saponite, hectorite, sauconite, stevensite and the like.

Instead of naturally-occurring materials (clay-based minerals), these swellable lamellar inorganic components may also be synthetic forms or processed forms (for example, surface-treated with a silane coupling agent), and for example, there may be mentioned synthetic smectite represented by the formula $Na_{0.1\text{-}1.0}Mg_{2.4\text{-}2.9}Li_{0.0\text{-}0.6}Si_{3.5\text{-}4.0}O_{9.0\text{-}10.6}(OH \text{ and/or } F)_{1.5\text{-}2.5}$. The method of producing synthetic smectite or synthetic mica may be any of three methods: hydrothermal reaction (see Japanese Unexamined Patent Publication (Kokai) No. 6-345419), solid-phase reaction method or a molten method (see Japanese Unexamined Patent Publication (Kokai) No. 5-270815).

Hydrothermal reaction is a synthesis process comprising reacting an aqueous solution or aqueous slurry containing various raw materials such as silicates, magnesium salts, alkali metal ions, alkali metal salts and fluoride ion in an autoclave or pipe reactor at a high temperature of 100-400° C. under high pressure. Because crystal growth is slow in a hydrothermal reaction, it is generally impossible to obtain large particles, and virtually all of the particles have sizes between 10 and 100 nm. Yet, it is still possible to produce large particles of 1 μm or greater by hydrothermal reaction if the synthesis is carried out with a low concentration, low temperature and prolonged time. However, the excessively high production cost in this case is a major problem.

Solid-phase reaction is a method in which synthetic mica is produced by reacting talc, an alkali silicofluoride and other raw materials for several hours in a temperature range of 400-1000° C. As a solid-phase reaction produces mica by causing elemental migration while leaving the original talc structure (topotaxy), the quality of the resulting synthetic mica depends on physical properties and impurities of the original talc, and because elemental migration cannot be completely controlled, the purity and crystallinity of the synthetic mica is often low.

A molten method is a method of producing synthetic mica or synthetic smectite by melting an anhydrous silicate, magnesium oxide, aluminum oxide, potassium silicofluoride, potassium carbonate or another raw material at the melting point of mica (for example, 1500° C.) or higher, and then slowly cooling to crystallization. Depending on the selected heating step, this method may be accomplished by an external heat molten process or an internal heat molten process. An external heat molten process is a production method in which a crucible containing the raw materials is placed in a chamber at a temperature above the melting point and heated, and is then transferred to a chamber at a temperature below the melting point, but this process is costly due to the expense of the crucibles. An internal heat molten process accomplishes heated melting of the raw materials by electrification in a vessel provided with graphite (carbon) electrodes or metal electrodes, followed by cooling, and internal heat molten processes are usually employed for molten synthesis. Molten synthesis methods can produce synthetic products with controlled particle sizes by pulverization and size sieving of the cooled and crystallized mass. As molten synthesis methods can employ raw materials of high purity and allow uniform mixture of the raw materials by the melting step, they are advantageous from the standpoint of allowing production of synthetic mica or synthetic smectite with a high degree of crystallinity, large particle sizes and high purity.

As examples of synthetic swellable lamellar inorganic components, there may be mentioned synthetic micas such as fluorophlogopite ($KMg_3AlSi_3O_{10}F$, molten or solid-phase reaction method), potassium tetrasilicone mica ($KMg_{2.5}Si_4O_{10}F_2$, molten method), sodium tetrasilicone mica ($NaMg_{2.5}Si_4O_{10}F_2$, molten method), sodium taeniolite ($NaMg_2LiSi_4O_{10}F_2$, molten method) and lithium taeniolite ($LiMg_2LiSi_4O_{10}F_2$, molten method), or synthetic smectites such as sodium hectorite ($Na_{0.33}Mg_{2.67}Li_{0.33}Si_{4.0}O_{10}$(OH or F)$_2$, hydrothermal reaction or molten method), lithium hectorite ($Na_{0.33}Mg_{2.67}Li_{0.33}Si_{4.0}O_{10}$ (OH or F)$_2$, hydrothermal reaction or molten method) and saponite ($Na_{0.33}Mg_{2.67}AlSi_{4.0}O_{10}(OH)_2$, hydrothermal reaction method)

Among these swellable lamellar inorganic components, there are preferably used synthetic micas such as sodium tetrasilicone mica, sodium taeniolite and lithium taeniolite, synthetic smectites such as sodium hectorite, lithium hectorite and saponite, and natural smectites such as montmorillonite. Sodium tetrasilicone mica is particularly preferred among these, and the desired particle sizes, aspect ratios and crystallinity can be obtained by molten synthesis.

As examples of commercially available clay minerals there may be mentioned natural bentonite, commonly known as sodium bentonite, Kunipia (trade name of Kunimine Industries Co., Ltd., natural montmorillonite), Smectone (trade name of Kunimine Industries Co., Ltd., hydrothermal synthesized smectite), Veegum (trade name of Vanderbilt, Inc.), Laponite (trade name of Laporte Industries Co., Ltd.), DM Clean A, DMA-350, Na-Ts (trade names of Topy Industries Co., Ltd., all three molten synthesized mica, sodium tetrasilicone mica) and Bengel (trade name of Hojun Corp.), any of which may be used alone or in mixtures of two or more.

A swellable lamellar inorganic component preferably used for the present invention is a swellable lamellar inorganic component which readily swells, cleaves and disperses in water. The degree of "swelling and cleavage" of the swellable lamellar inorganic component in the solvent may be evaluated by "swelling/cleavage" property tests. The swelling of the swellable lamellar inorganic component is preferably about 5 ml/2 g or greater, and more preferably about 20 ml/2 g or greater.

Specifically, the swelling forces of the swellable lamellar inorganic components are, for example, as follows: Kunipia (swelling force: 65 ml/2 g or greater), Smectone (swelling force: 60 ml/2 g or greater), DM Clean A, DMA-350, Na-Ts (swelling force: 30 ml/2 g or greater), ME-100 (trade name of Co-Op Chemical Co., Ltd., swelling force: 20 ml/2g or greater) and Bengel (swelling force: 38 ml/2 g or greater).

The swelling property test will now be explained. Using a 100 ml graduated cylinder as the test vessel, 2 g of the swellable lamellar inorganic component is slowly added to 100 ml of solvent and the mixture is allowed to stand, and after 24 hours at 23° C., the volume of the swellable lamellar inorganic component dispersion layer is determined by reading the scale where the interface of the obtained swellable lamellar inorganic component dispersion layer and the supernatant layer exits. A larger numerical value (ml/2 g) is preferred, indicating a higher swelling property. The solvent used is preferably water.

The cleavage property of the swellable lamellar inorganic component is preferably at least about 5 ml, and more preferably at least about 20 ml. The solvent used for measurement of the cleavage is a solvent having a density lower than the density of the swellable lamellar inorganic component, and it is preferably water.

The cleavage property test will now be explained. After slowly adding 30 g of the swellable lamellar inorganic component to 1500 ml of the swelling solvent, the mixture is dispersed for 90 minutes using a disperser (trade name: DISPER MH-L, product of Asada Iron Works Co., Ltd., 52 mm blade diameter, 3100 rpm, 3 L vessel volume, 28 mm bottom-blade distance) at a circumferential speed of 8.5 m/sec (solvent temperature: 23° C.), and then 100 ml of the dispersion is transferred into a graduated cylinder and allowed to stand for 60 minutes, after which the volume of the swellable lamellar inorganic component dispersion layer is determined by reading the scale where the interface of the swellable lamellar inorganic component dispersion layer and the supernatant layer exists.

The swellable lamellar inorganic component used has an aspect ratio of 100-5000, and preferably an aspect ratio of 500-5000. An aspect ratio of less than 100 may result in bleeding of images, while an aspect ratio of greater than 5000 may impair the image uniformity. The aspect ratio (Z) is represented by the relationship $Z = L/a$, where L is the mean particle diameter of the swellable lamellar inorganic component in water (as measured by laser diffraction, using an LA-910 by Horiba Co., Ltd.; median diameter at a volume distribution of 50%), and a is the thickness of the swellable lamellar inorganic component. The thickness is the value determined by observation of a scanning electron microscopy (SEM) or a transmission electron microscopy (TEM) photograph of the cross-section of the barrier layer. The mean particle diameter of the swellable lamellar inorganic component is 0.1-100 μm, preferably 0.3-50 μm and more preferably 0.5-20 μm. If the mean particle diameter is less than 0.1 μm, the aspect ratio will be too small and it may be difficult to lay the compound in parallel on the intermediate layer, making it impossible to fully prevent bleeding of images. If the mean particle diameter is larger than 100 μm, the swellable lamellar inorganic component may protrude out from the barrier layer producing irregularities on the barrier layer surface, thus impairing the smoothness of the receiving layer and deteriorating the image quality.

According to the present invention, the adhesive used for formation of the barrier layer is preferably an aqueous polymer compound such as a water-soluble polymer or a water-dispersible resin. For example, there may be mentioned water-soluble polymers including starch, modified starch, hydroxyethyl cellulose, methyl cellulose, carboxymethyl cellulose, gelatin, casein, gum Arabic, polyvinyl alcohols such as totally saponified polyvinyl alcohol, partially saponified polyvinyl alcohol, carboxy-modified polyvinyl alcohol and acetoacetyl-modified polyvinyl alcohol, resins such as ethylene-vinyl alcohol copolymer resin, diisobutylene-maleic anhydride copolymer salts, styrene-maleic anhydride copolymer salts, styrene-acrylic acid copolymer salts and ethylene-acrylic acid copolymer salts, urea resins, urethane resins, melamine resins and amide resins, and water-dispersible resins such as styrene-butadiene-based copolymer latexes, acrylic acid ester resin-based latexes, methacrylic acid ester-based copolymer latexes, ethylene-vinyl acetate copolymer latexes, polyester-polyurethane ionomers and polyether-polyurethane ionomers. These aqueous polymer compounds may be used alone or in mixtures of two or more.

Water-soluble polymer compounds are preferably used among these aqueous polymer compounds, and for example, polyvinyl alcohol, ethylene-vinyl alcohol copolymer resin and ethylene-acrylic acid copolymer resin are preferably used, for a notable effect of improving image bleeding. Also, an excellent effect from the standpoint of water resistance can be obtained by using ethylene-vinyl alcohol copolymer resins and ethylene-acrylic acid copolymer resins. The coating solution prepared using a water-soluble polymer compound preferably has a suitably low viscosity, as distinct images can be obtained presumably due to uniform dispersion of the water swellable lamellar inorganic component. For example, in the case of a totally saponified polyvinyl alcohol, the polymerization degree is preferably no greater than 2000 and more preferably no greater than 300-1000.

According to the present invention, the mixing ratio of the swellable lamellar inorganic component and the adhesive as the constituent materials of the barrier layer is preferably 1-100 parts by weight, and more preferably 5-50 parts by weight, of the swellable lamellar inorganic component to 100 parts by weight of the adhesive. The material of the barrier layer may be any of various inorganic or organic pigments, waxes, metal soaps and the like and, if necessary, there may also be used various additives such as ultraviolet absorbers, fluorescent dyes, oil repellents, antifoaming agents, viscosity modifiers, crosslinking agents, curing agents and the like, in ranges which do not interfere with the desired effect.

The solid coverage of the barrier layer is preferably 0.1-10 $g/m^2$, and more preferably 0.5-5 $g/m^2$. If the solid coverage is less than 0.1 $g/m^2$, the barrier layer will not form a sufficient film, and the desired effect of preventing image bleeding will not be exhibited. The solid coverage is preferably not greater than 10 $g/m^2$ because the bleed-preventing effect will be saturated, creating an economically undesirable situation.

The substrate used for the receiving sheet of the present invention is a paper composed mainly of cellulose pulp, or a synthetic resin film. For example, there may be appropriately used woodfree paper (acid paper, acid-free paper), wood-containing paper, coated paper, art paper, glassine paper or resin laminated paper, or oriented film composed mainly of polyolefins such as polyethylene or polypropylene, polyesters such as polyethylene terephthalate, polyamides, polyvinyl chloride, polystyrene or the like, single-layer oriented film or multilayer structured film composed mainly of thermoplastic resins such as polyolefins (synthetic sheets), and composite film obtained by laminating these films together, or by laminating one of these films to another type of film or to paper. While there are no particular restrictions, paper substrates composed mainly of cellulose pulp provide a cost advantage, and a superior effect of the present invention can also be obtained. The sheet-like substrate used for the present invention preferably has a thickness of 20-300 μm.

According to the present invention, the hollow particles used in the optional intermediate layer may be microcapsules comprising a low boiling point hydrocarbon such as n-butane, i-butane, pentane, neopentane or the like as the nucleus and a homopolymer or a copolymer resin of, e.g., polyacrylonitrile or methyl methacrylate, as the shell.

According to the present invention, the mean particle size of the hollow particles after formation of the intermediate layer is preferably 0.1-20 μm and more preferably 0.5-20 μm. For example, the intermediate layer may be formed by preparing an intermediate layer coating comprising pre-expanded particles, or by preparing an intermediate layer coating comprising unexpanded particles, coating the intermediate layer, and then expanding the particles. If the mean particle size of the hollow particles in the intermediate layer exceeds 20 μm, the smoothness will be impaired and the quality may be poor. If it is less than 0.1 μm, it may not be possible to achieve adequate heat insulation, less ink may be transferred from the ink sheet, and the image density may therefore be reduced. The volume void fraction (hereinafter also referred to simply as the "void fraction") of the hollow particles is preferably 30-95%, because if the void fraction is less than 30%, the heat insulation may be insufficient and adequate density may not be achieved. If it is greater than 95%, the shell thickness of the hollow particles will be reduced, tending to result in problems such as collapse of the hollow particles and lower heat insulation. The particle sizes of the hollow particles are measured by a laser diffraction method, in the same manner as that for the swellable lamellar inorganic component mentioned above. The void fraction of the hollow particles may be determined based on the volume specific gravity of the aqueous dispersion of the hollow particles, the solid concentration, and the true specific gravity of the resin composing the hollow particle shells.

According to the present invention, the adhesive used in the optional intermediate layer is, similar to the barrier layer, preferably an aqueous polymer compound such as a water-soluble polymer or water-dispersible resin. Polyvinyl alcohol is preferred among water-soluble polymer compounds, and ethylene-vinyl acetate copolymer latexes and acrylic acid ester resin-based latexes are preferably used among water-dispersible resins. The aforementioned water-soluble polymer compounds may be used alone, or mixtures of two or more thereof may be used.

According to the present invention, the mixing ratio of the hollow particles and the adhesive as the constituent materials of the optional intermediate layer is preferably 10-300 parts by weight, and more preferably 80-250 parts by weight, of the hollow particles to 100 parts by weight of the adhesive. At less than 10 parts by weight of hollow particles to 100 parts by weight of the adhesive, sufficient heat insulation may not be obtained and the printed image density may be reduced, impairing the image quality. At greater than 300 parts by weight of hollow particles to 100 parts by weight of the adhesive, the coated film strength may be reduced, and peeling or cracking of the coated film may occur. The material of the intermediate layer may be any of various inorganic or organic pigments, waxes, metal soaps and the like, and if necessary, there may also be used various additives such as ultraviolet absorbers, fluorescent dyes, oil repellents, antifoaming agents, viscosity modifiers and the like, in ranges which do not interfere with the desired effect.

The solid coverage of the intermediate layer is preferably 1-50 g/m$^2$, and more preferably 5-20 g/m$^2$. If the solid coverage of the intermediate layer is less than 1 g/m$^2$, sufficient heat insulating and cushion properties will not be obtained and the density will be reduced, thus impairing the image quality. The solid coverage is preferably not greater than 50 g/m$^2$ because the effect on the heat insulating and cushion properties will be saturated, creating an economically undesirable situation.

According to the present invention, the receiving sheet has a construction comprising an optional intermediate layer, followed by a barrier layer and receiving layer, formed in that order on a substrate, and the receiving layer used may be a publicly known sublimation dye thermal transfer receiving layer. The resin forming the receiving layer is a resin which has a high affinity for the dye which migrates from the ink sheet and also a good dye fixability. As such dye fixable resins, there may be used polyester resins, polycarbonate resins, vinyl chloride copolymers, polyvinyl acetal resins, cellulose derivative resins such as cellulose acetate butyrate, and acrylate resins. In order to prevent fusion of the receiving layer with the ink sheet by heating with the thermal head during printing, it is preferred to add at least one type of crosslinking agent, lubricant and release agent to the resin. If necessary, one or more fluorescent dyes, plasticizers, antioxidants, ultraviolet absorbers or pigments may be added to the resin. Such additives may be combined with the receiving layer-forming components prior to coating. They may alternatively be coated above and/or below the receiving layer as covering layers separate from the receiving layer.

The solid coverage of the receiving layer is preferably about 1-15 g/m$^2$ and more preferably 3-10 g/m$^2$. If the coverage of the receiving layer is less than 1 g/m$^2$, it may not be possible to fully cover the substrate surface with the receiving layer, which may result in reduced image quality or fusion problems in which the ink sheet and receiving layer stick together upon heating with the thermal head. On the other hand, a coverage exceeding 15 g/m$^2$ is not only uneconomical due to saturation of the effect, but the coated receiving layer may be poor in strength or the receiving layer thickness will increase, thus preventing an adequate heat insulating effect for the substrate and possibly reducing the printing density.

The method of forming the coated layers for the intermediate layer, barrier layer, receiving layer, etc. may involve application of each prepared coating solution using any of various coating apparatuses such as an air knife coater, varibar blade coater, pure blade coater, rod blade coater, short dwell coater, curtain coater, die coater, gravure coater, roll coater, spray coater, dip coater, bar coater, comma coater, offset roll coater, reverse roll coater, lip coater, slide bead coater or the like. When drying is required, it may be carried out by a conventional method in combination with these coating apparatuses. When radiation curing is required, an irradiating apparatus such as an ultraviolet irradiating or electron beam irradiating apparatus may be appropriately used to accomplish curing.

The receiving sheet of the present invention may, if necessary, have a primer coating layer formed beforehand for the purpose of preventing penetration of the intermediate layer coating composition into the substrate during formation of the intermediate layer. Also, for the purpose of preventing electrification of the receiving sheet, rectifying curls in the receiving sheet and preventing multi-feeding of the receiving sheet in the printer during printing, a backing layer may also be provided on the back side of the receiving sheet. A super-calender treatment may, of course, also be carried out.

Formation of a backing layer can result in a smoother procedure of supplying the receiving sheet to the printer, transporting it through the printer and ejecting it from the printer. The backing layer is preferably composed mainly of a backing layer-forming resin, if necessary, with one or more lubricants, release agents, antistatic agents, organic and/or inorganic pigments or the like. The solid coverage of the backing layer is preferably in the range of 0.3-10 g/m$^2$, and even more preferably in the range of 1-5 g/m$^2$.

The receiving sheet of the present invention may also have a structure wherein the barrier layer and receiving layer are laminated in that order on one side of the substrate, and then an adhesive layer (a pressure sensitive adhesive layer), release layer and release sheet base (throughout the present specification, the release sheet base with the release layer will also be referred to as "release sheet") laminated in that order on the other side of the substrate. This structure constitutes a seal type or label type receiving sheet which allows attachment and release between the adhesive layer and release layer. According to another embodiment, therefore, the present invention provides a seal type or label type (hereinafter both referred to as "seal type") receiving sheet.

A seal type receiving sheet preferably has an overall thickness of 100-300 μm. If the thickness is less than 100 μm, the mechanical strength and rigidity of the receiving sheet may be insufficient, and it may not be possible to adequately prevent curls in the receiving sheet which are produced during printing. If the thickness is greater than 300 μm, the number of receiving sheets held by the printer will be small and a receiving sheet tray with greater volume will be necessary to hold a predetermined number of sheets, thus making it difficult to produce a compact printer.

(Adhesive Layer)

In a seal type receiving sheet of the present invention, the adhesive resin used for the adhesive layer may be a publicly known adhesive resin such as an acrylic-based, rubber-based or silicone-based resin. Acrylic-based resins are preferred among such adhesive resins. As acrylic-based resins there are preferably used resins composed mainly of 2-ethylhexyl acrylate, butyl acrylate or ethyl acrylate, obtained by copolymerization of these with one or more other (meth)acrylic acid esters (non-functional, or (meth)acrylic acid esters having various functional groups), or other copolymerizable monomers. If necessary, tackifiers such as rosins and the like, isocyanate-based and epoxy-based crosslinking agents, age resisters, stabilizers, softeners such as oils, fillers, pigments, coloring agents and the like may be added to these adhesive resins. Also, combinations of two or more thereof may be used as necessary.

The solid coverage of the adhesive layer is preferably 5-30 g/m$^2$, and more preferably 7-25 g/m$^2$. The adhesive layer may be formed by using a coater selected from among bar coaters, gravure coaters, comma coaters, blade coaters, air knife coaters, die coaters, curtain coaters, lip coaters and slide bead coaters, for application of the adhesive layer coating solution by an ordinary method followed by drying.

As to the order for forming the adhesive layer, first the adhesive layer coating solution may be applied onto the release surface of the release layer formed on the release sheet base and dried to form an adhesive layer, and then the adhesive layer surface may be attached by lamination against the substrate side having the receiving layer on the surface, or the adhesive layer coating solution may be coated onto the opposite side of the substrate having the receiving layer and dried to form the adhesive layer, and then the adhesive layer side and the release surface of the release sheet may be attached by lamination against each other.

(Release Sheet Base)

The release sheet base used for a seal type receiving sheet of the present invention may be the same as that for the substrate of the receiving sheet. Preferred is a laminated sheet having a thermoplastic resin layer of a polyolefin resin or the like formed on at least one side, or a film composed mainly of a synthetic resin such as a polyester (for example, polyethylene terephthalate). The thickness of the release sheet base is preferably in the range of 20-200 μm, and more preferably 50-150 μm.

(Release Layer)

According to the present invention, the used release-treated release sheet may be one having, for example, a release layer formed on a release sheet base, and the release layer may include a publicly known release agent. The release agent used is preferably an emulsion-type, solvent-type or solvent free-type silicone resin, fluorine resin or the like. In this case, the release layer coating solution is applied and dried on the release sheet base to a solid coverage of the release layer of 0.1-3 g/m$^2$ and more preferably of 0.3-1.5 g/m$^2$, and then it is cured by heat curing, an electron beam, ultraviolet curing or the like to form the release layer. The method of forming the release layer is not particularly restricted and, for example, a coater such as a bar coater, direct gravure coater, offset gravure coater or air knife coater may be used, as appropriate, for coating and drying of the release layer coating solution onto the release sheet base.

For a seal type receiving sheet, a backing layer may also be formed on the side of the release sheet base opposite the side on which the release layer has been formed. The backing layer of the release sheet base is formed in the same manner as the backing layer on the receiving sheet, and formation of a backing layer on the receiving sheet section may be omitted.

EXAMPLES

The present invention will now be explained in greater detail through examples, although the present invention is, naturally, not limited to these examples. The "parts" and "%" values in the examples all refer to "parts by weight" and "wt %".

Example 1

(Formation of Intermediate Layer Coated Sheet)

An intermediate layer coating solution was prepared by mixing and stirring 70 parts of an aqueous dispersion (solid concentration: 30%) of expanded hollow particles comprising a thermoplastic resin composed mainly of vinylidene chloride and acrylonitrile (mean particle size: 5.4 μm, void fraction: 60%), 15 parts of an aqueous solution (solid concentration: 10%) of polyvinyl alcohol (trade name: PVA217, Kuraray Co., Ltd.) and 15 parts of styrene-butadiene latex (trade name: L-1537, solid concentration: 50%, Asahi Kasei). This was then applied and dried on one side of an art paper sheet (trade name: OK Kinfuji-N, basis weight: 186 g/m$^2$, Oji Paper Co. Ltd.) as the substrate using a die coater to a dry coverage of 20 g/m$^2$, to form an intermediate layer coated sheet.

(Formation of Barrier Layer Coated Sheet)

A barrier layer coating solution was prepared by mixing and stirring 100 parts of an aqueous solution (solid concentration: 10%) of polyvinyl alcohol (trade name: PVA105, polymerization degree: approximately 500, Kuraray Co., Ltd.) and 4 parts of styrene-butadiene latex (trade name: L-1537, solid concentration: 50%, Asahi Kasei) with 100 parts of an aqueous dispersion of the swellable lamellar inorganic component sodium tetrasilicone mica (mean particle diameter: 6.3 μm, 5% aqueous dispersion). The barrier layer coating solution was then applied and dried on the intermediate layer of the aforementioned intermediate layer coated sheet using a Meyer bar coater to a dry coverage of 3 g/m$^2$, to form a barrier layer coated sheet. The aspect ratio of the swellable lamellar inorganic component was 2700, as calculated from the thickness measured by cross-sectional observation of the barrier layer coated sheet.

(Formation of Backing Layer Coated Sheet)

A backing layer coating solution was prepared by mixing and stirring 100 parts of an aqueous solution (solid concentration: 10%) of polyvinyl alcohol (trade name: PVA117, Kuraray Co., Ltd.) and 20 parts of zinc stearate (trade name: Z-8-36, solid concentration: 30%, Chukyo Yushi Co., Ltd.). The backing layer coating solution was then applied and dried on the back side of the barrier layer coated sheet using a Meyer bar coater to a dry coverage of 2 g/m$^2$, to form a backing layer coated sheet.

(Formation of Receiving Sheet)

A receiving layer coating solution was prepared by dissolving 100 parts of a polyester resin (trade name: BYLON-200, Toyobo Co., Ltd.), 2 parts of silicone oil (trade name: KF393, Shinetsu Kagaku) and 6 parts of an isocyanate compound (trade name: Takenate D-110N, Takeda Pharmaceutical Co., Ltd.) in 200 parts of a toluene/methyl ethyl ketone=1/1 (weight ratio) mixed solvent, and mixing and stirring the solution. The receiving layer coating solution was applied and dried on the barrier layer of the backing layer coated sheet using a gravure coater to a dry coverage of 6 g/m$^2$, to obtain a receiving sheet.

Example 2

A receiving sheet was prepared in the same manner as Example 1, except that, instead of the expanded hollow particles comprising a thermoplastic resin composed mainly of vinylidene chloride and acrylonitrile (mean particle size: 5.4 μm) for formation of the intermediate layer coated sheet of Example 1, there was used an aqueous dispersion (solid concentration: 30%) of expanded hollow particles comprising a thermoplastic resin composed mainly of vinylidene chloride and acrylonitrile but having a different particle size (mean particle size: 1.6 μm, void fraction: 50%).

Example 3

A receiving sheet was prepared in the same manner as Example 1, except that, instead of the expanded hollow particles comprising a thermoplastic resin composed mainly of vinylidene chloride and acrylonitrile (mean particle size: 5.4 μm) for formation of the intermediate layer coated sheet of Example 1, there was used an aqueous dispersion (solid concentration: 30%) of expanded hollow particles comprising a thermoplastic resin composed mainly of vinylidene chloride and acrylonitrile but having a different particle size (mean particle size: 18.1 μm, void fraction: 65%).

Example 4

A receiving sheet was prepared in the same manner as Example 1, except that, instead of an aqueous dispersion of the swellable lamellar inorganic component, sodium tetrasilicone mica (mean particle diameter: 6.3 μm, 5% aqueous dispersion), for formation of the barrier layer coated sheet of Example 1, there was used an aqueous dispersion of the swellable lamellar inorganic component sodium tetrasilicone mica with a different mean particle diameter (mean particle diameter: 14.5 μm, 5% aqueous dispersion). The aspect ratio of the swellable lamellar inorganic component was 4800, as calculated from the thickness measured by cross-sectional observation of the barrier layer coated sheet.

Example 5

A receiving sheet was prepared in the same manner as Example 1, except that instead of an aqueous dispersion of the swellable lamellar inorganic component, sodium tetrasilicone mica (mean particle diameter: 6.3 μm, 5% aqueous dispersion), for formation of the barrier layer coated sheet of Example 1, there was used an aqueous dispersion of the swellable lamellar inorganic component sodium tetrasilicone mica with a different mean particle diameter (mean particle diameter: 1.5 μm, 5% aqueous dispersion). The aspect ratio of the swellable lamellar inorganic component was 180, as calculated from the thickness measured by cross-sectional observation of the barrier layer coated sheet.

Example 6

A receiving sheet was prepared in the same manner as Example 1, except that a barrier layer coated sheet formed by the following method was used as the barrier layer coated sheet formed in Example 1.

(Formation of Barrier Layer Coated Sheet)

A barrier layer coating solution was prepared by mixing and stirring 100 parts of an aqueous solution (solid concentration: 10%) of ethylene-vinyl alcohol copolymer resin (trade name: Exceval 4105, Kuraray Co., Ltd.) with 100 parts of an aqueous dispersion of the swellable lamellar inorganic component sodium tetrasilicone mica (mean particle diameter: 6.3 μm, 5% aqueous dispersion). The barrier layer coating solution was then applied and dried on the intermediate layer of the aforementioned intermediate layer coated sheet using a Meyer bar coater to a dry coverage of 3 g/m$^2$, to form a barrier layer coated sheet. The aspect ratio of the swellable lamellar inorganic component was 2700, as calculated from the thickness measured by cross-sectional observation of the barrier layer coated sheet.

Example 7

A receiving sheet was prepared in the same manner as Example 1, except that a barrier layer coated sheet formed by the following method was used as the barrier layer coated sheet formed in Example 1.

(Formation of Barrier Layer Coated Sheet)

A barrier layer coating solution was prepared by mixing and stirring 50 parts of an aqueous solution (solid concentration: 28%) of ethylene-acrylic acid copolymer resin (trade name: ET-1000, Chuo Rika Kogyo Co., Ltd.) with 100 parts of an aqueous dispersion of the swellable lamellar inorganic component sodium tetrasilicone mica (mean particle diameter: 6.3 μm, 5% aqueous dispersion). It was then applied and dried on the intermediate layer of the aforementioned intermediate layer coated sheet using a Meyer bar coater to a dry coverage of 3 g/m$^2$, to form a barrier layer coated sheet. The aspect ratio of the swellable lamellar inorganic component was 2700, as calculated from the thickness measured by cross-sectional observation of the barrier layer coated sheet.

Comparative Example 1

A receiving sheet was prepared in the same manner as Example 1, except that a barrier layer coated sheet formed by the following method was used as the barrier layer coated sheet formed in Example 1.

(Formation of Barrier Layer Coated Sheet)

A barrier layer-coated sheet was formed by using an aqueous solution (solid concentration: 10%) of polyvinyl alcohol (PVA105, Kuraray Co., Ltd.) as the barrier layer coating solution, and coating and drying it on the intermediate layer of the intermediate layer coated sheet using a Meyer bar coater to a dry coverage of 5 g/m$^2$.

Comparative Example 2

A receiving sheet was prepared in the same manner as Example 1, except that instead of an aqueous dispersion of the swellable lamellar inorganic component sodium tetrasilicone mica (mean particle diameter: 6.3 μm, 5% aqueous dispersion) for formation of the barrier layer coated sheet of Example 1, there was used an aqueous dispersion of muscovite as a non-swelling clay mineral (mean particle diameter: 20 μm, 5% aqueous dispersion). The aspect ratio of the non-swelling clay mineral was 55, as calculated from the thickness measured by cross-sectional observation of the barrier layer coated sheet.

Comparative Example 3

A receiving sheet was prepared in the same manner as Example 1, except that instead of an aqueous dispersion of the swellable lamellar inorganic component sodium tetrasilicone mica (mean particle diameter: 6.3 μm, 5% aqueous dispersion) for formation of the barrier layer coated sheet of Example 1, there was used an aqueous dispersion of the swellable lamellar inorganic component sodium tetrasilicone mica with a different mean particle diameter (mean particle diameter: 105 μm, 3% aqueous dispersion). The aspect ratio of the swellable lamellar inorganic component was 7600, as calculated from the thickness measured by cross-sectional observation of the barrier layer coated sheet.

Example 8

(Formation of Receiving Sheet Section)

An intermediate layer coated sheet was fabricated in the same manner as Example 1, except that an art paper sheet (trade name: OK Kinfuji-N, basis weight: 104.7 g/m$^2$, Oji Paper Co. Ltd.) was used as the substrate instead of the art paper sheet (trade name: OK Kinfuji-N, basis weight: 186 g/m$^2$, Oji Paper Co. Ltd.) for formation of the intermediate layer coated sheet.

The rest of the procedure was carried out in the same manner as Example 1 to form a barrier layer and a receiving layer, in that order, on the intermediate layer of the intermediate layer coated sheet, to obtain a receiving sheet section. However, formation of the backing layer was omitted.

(Formation of Release Sheet Base)

Low-density polyethylene also comprising titanium dioxide (trade name: YUKALON LK50, Mitsubishi Chemical Co., Ltd.) was coated by melt extrusion onto both sides of woodfree paper with a thickness of 67 μm (trade name: OK Woodfree Paper, basis weight: 52.3 g/m$^2$, Oji Paper Co. Ltd.), to 20 μm on each side, to obtain a release sheet base.

(Formation of Release Layer Coated Sheet)

A silicone-based release agent (trade name: KS830, Shinetsu Kagaku) was then coated and dried on one side of the obtained release sheet base using a gravure coater to a dry coverage of 0.5 g/m$^2$, to form a release layer coated sheet.

(Formation of Backing Layer Coated Release Sheet)

A backing layer coating solution was prepared by mixing and stirring 100 parts of an aqueous solution (solid concentration: 10%) of polyvinyl alcohol (trade name: PVA117, Kuraray Co., Ltd.) and 20 parts of zinc stearate (trade name: Z-8-36, solid concentration: 30%, Chukyo Yushi Co., Ltd.). The backing layer coating solution was then applied and dried on the side of the release layer coated sheet without the release layer, using a Meyer bar coater to a dry coverage of 2 g/m$^2$, to form a backing layer coated sheet.

(Formation of Seal-type Receiving Sheet)

An adhesive layer coating solution was prepared by mixing and stirring 400 parts of an acrylic-based adhesive (trade name: PE115E, solid concentration: 23%, Nihon Carbide) and 3 parts of a curing agent (trade name: CK101, solid concentration: 75%, Nihon Carbide). The adhesive layer coating solution was then coated and dried on one side of the backing layer coated release sheet using a gravure coater to a dry coverage of 15 g/m$^2$, to form an adhesive layer coated release sheet.

The adhesive layer side of the adhesive layer coated release sheet was placed over the substrate side of the receiving sheet section (the side opposite the receiving layer) and adhesively laminated to form a seal type receiving sheet.

Example 9

A seal-type receiving sheet was prepared in the same manner as Example 8, except for using an aqueous dispersion (solid concentration: 30%) of expanded hollow particles comprising a thermoplastic resin composed mainly of vinylidene chloride and acrylonitrile (mean particle size: 1.6 μm, void fraction: 50%), as used in Example 2, for formation of the intermediate layer coated sheet.

Example 10

A seal-type receiving sheet was prepared in the same manner as Example 8, except for using an aqueous dispersion (solid concentration: 30%) of expanded hollow particles comprising a thermoplastic resin composed mainly of vinylidene chloride and acrylonitrile (mean particle size: 18.1 μm, void fraction: 65%), as used in Example 3, for formation of the intermediate layer coated sheet.

Example 11

A seal type receiving sheet was prepared in the same manner as Example 8, except for using an aqueous dispersion of the swellable lamellar inorganic component sodium tetrasilicone mica (mean particle diameter: 14.5 μm, 5% aqueous dispersion), as in Example 4, for formation of the barrier layer coated sheet.

Example 12

A seal type receiving sheet was prepared in the same manner as Example 8, except for using an aqueous dispersion of the swellable lamellar inorganic component sodium tetrasilicone mica (mean particle diameter: 1.5 μm, 5% aqueous dispersion), as in Example 5, for formation of the barrier layer coated sheet.

Example 13

A seal type receiving sheet was prepared in the same manner as Example 8, except that the barrier layer was formed, by the same method as in Example 6, for formation of the barrier layer coated sheet.

Example 14

A seal type receiving sheet was prepared in the same manner as Example 8, except that the barrier layer was formed, by the same method as in Example 7, for formation of the barrier layer coated sheet.

Example 15

A seal type receiving sheet was prepared in the same manner as Example 8, except for using an oriented porous polyester film with a thickness of 100 μm and composed mainly of polyethylene terephthalate (trade name: W900E100, Mitsubishi Chemical Polyester Film Co.) as the release sheet base, for formation of the release layer coated sheet.

Comparative Example 4

A seal type receiving sheet was prepared in the same manner as Example 8, except that the barrier layer coated sheet was formed by the same method as in Comparative Example 1, for formation of the barrier layer coated sheet.

Comparative Example 5

A seal type receiving sheet was prepared in the same manner as Example 8, except that an aqueous dispersion of muscovite (mean particle diameter: 20 μm, 5% aqueous dispersion) was used as a non-swelling clay mineral in the same manner as in Comparative Example 2, for formation of the barrier layer coated sheet.

Comparative Example 6

A seal type receiving sheet was prepared in the same manner as Example 8, except that an aqueous dispersion of the swellable lamellar inorganic component sodium tetrasilicone mica (mean particle diameter: 105 μm, 3% aqueous dispersion) was used in the same manner as in Comparative Example 3, for formation of the barrier layer coated sheet.

Evaluation

The receiving sheets prepared in the aforementioned examples and comparative examples were evaluated by the methods described below, and the results are shown in Table 1.

"Print Quality" (Print Density, Image Uniformity)

Using a commercially available thermal transfer video printer (trade name: UP-DR100, Sony Corp.), ink sheets each having an ink layer containing one of three different sublimating dyes: yellow, magenta or cyan, together with a binder formed on a 6 μm-thick polyester film, were contacted in sequence with a receiving sheet, and the heat was controlled in stages with a thermal head for thermal transfer of a predetermined image into the receiving sheet, to accomplish printing of an image with simple halftones of each color and superimposed colors. The reflection density of the recorded images transferred onto the receiving sheet was measured using a Macbeth reflection densitometer (trade name: RD-914, Kollmorgen Co.), for each applied energy. Table 1 shows the printing density as the concentration of the high tone section corresponding to the 15th step from the lowest applied energy.

The uniformity of the recorded images at the tone section corresponding to an optical density (black) of 0.3 was visually evaluated, based on the presence or absence of uneven density and dropouts. The evaluation results were indicated as "good", "fair", or "poor" where notable defects such as uneven density and dropouts were observed.

"Post-Printing Curl"

The receiving sheets prepared in the examples and comparative examples, each in roll form with a width of 127 mm, were fed to a thermal transfer printer (trade name: UP-DR100, Sony) for printing of black images, and were cut at a length of 179 mm and ejected. The curling of the printed receiving sheets was measured as the post-printing curl. As the method of measuring the post-printing curl, the printed receiving sheet was placed on a level surface for 5 minutes, in an environment of 23° C., 50% RH, either with the receiving layer side facing upward (top curl) or the receiving layer side facing downward (back curl), and the maximum height among the four corners of each receiving sheet and the maximum height recorded as the post-printing curl. The degree of post-printing curl was evaluated on the following scale. "good": Post-printing back curl in a range of 0-20 mm. "fair": Post-printing back curl in a range of greater than 20 mm and up to 30 mm, or top curl in a range of greater than 0 mm and up to 10 mm. "poor": Post-printing back curl of greater than 30 mm or top curl of greater than 10 mm.

"Post-Printing Stability" (Image Bleeding)

Using a commercially available thermal transfer video printer (trade name: UP-DR100, Sony Corp.), ink sheets each having an ink layer containing one of three different sublimating dyes: yellow, magenta or cyan together with a binder formed on a 6 μm-thick polyester film, were contacted in sequence with a receiving sheet, and the heat was controlled in stages with a thermal head to accomplish thermal transfer of a predetermined image into the receiving sheet, and printing of black and blue narrow line images. This was followed by a post-printing stability acceleration test, wherein the image-printed sheet was allowed to stand for 2 weeks in an environment of 50° C., 95% RH. The image bleeding rate was calculated according to the following formula (1).

$$\text{Bleeding rate} = \frac{\text{(thickness of line after standing)}}{\text{(thickness of line before standing)}} \times 100 \quad (1)$$

A bleeding rate of less than 110% was evaluated as "good", a bleeding rate of at least 110% and less than 130% was evaluated as "fair", and a bleeding rate of 130% or greater was evaluated as "poor".

TABLE 1

| | Print density (black) | Image uniformity | Post-printing curl | Image bleeding |
|---|---|---|---|---|
| Example 1 | 2.24 | good | good | good |
| Example 2 | 2.12 | good | good | good |
| Example 3 | 2.39 | good | good | good |
| Example 4 | 2.21 | good | good | good |
| Example 5 | 2.29 | good | good | good |
| Example 6 | 2.29 | good | good | good |
| Example 7 | 2.34 | good | good | good |
| Comp. Ex. 1 | 2.23 | good | poor (top) | poor |
| Comp. Ex. 2 | 1.98 | fair | fair (top) | poor |
| Comp. Ex. 3 | 1.88 | poor | good | good |
| Example 8 | 2.22 | good | good | good |
| Example 9 | 2.11 | good | good | good |
| Example 10 | 2.37 | good | good | good |
| Example 11 | 2.22 | good | good | good |
| Example 12 | 2.29 | good | good | good |
| Example 13 | 2.28 | good | good | good |
| Example 14 | 2.33 | good | good | good |
| Example 15 | 2.25 | good | good | good |
| Comp. Ex. 4 | 2.24 | good | poor (top) | poor |
| Comp. Ex. 5 | 1.97 | fair | fair (top) | poor |
| Comp. Ex. 6 | 1.86 | poor | good | good |

INDUSTRIAL APPLICABILITY

The present invention provides a thermal transfer receiving sheet which produces high quality images, has a high image stability without bleeding of printed images over time, is inexpensive and exhibits an excellent anti-curl property during printing.

The invention claimed is:

1. A thermal transfer receiving sheet comprising a substrate, a barrier layer laminated on said substrate, and an image receiving layer laminated together on said barrier layer, wherein said barrier layer and said image receiving layer are laminated on at least one side of said substrate, characterized in that the major components of said barrier layer are a swellable lamellar inorganic component and an adhesive, wherein said swellable lamellar inorganic component has a mean particle diameter of a least 0.1 μm and not greater than 100 μm, and an aspect ratio (ration of mean particle diameter/thickness of the lamellar composite) of at least 100 and not greater than 5000.

2. A thermal transfer receiving sheet according to claim 1, wherein an intermediate layer comprising hollow particles is further laminated between said bamer layer and said substrate.

3. A thermal transfer receiving sheet according to claim 2, wherein the mean particle size of said hollow particles is at least 0.1 μm and not greater than 20 μm.

4. A thermal transfer receiving sheet according to claim 3, wherein the adhesive used in said barrier layer comprises an aqueous polymer compound as a major component.

5. A thermal transfer receiving sheet according to claim 4, wherein said aqueous polymer compound is al least one selected from the group consisting of polyvinyl alcohol, ethylene-vinyl alcohol copolymer resins and ethylene-acrylic acid copolymer resins.

6. A thermal transfer receiving sheet according to claim 5, wherein said substrate has an adhesive layer on the side opposite the image receiving layer side, and also has a release sheet having a release coating containing a release agent on said adhesive layer, where said release sheet is laminated to the adhesive layer on its release coating side.

7. A thermal transfer receiving sheet according to claim 4, wherein said substrate has an adhesive layer on the side opposite the image receiving layer side, and also has a release sheet having a release coating containing a release agent on said adhesive layer, where said release sheet is laminated to the adhesive layer on its release coating side.

8. A thermal transfer receiving sheet according to claim 3, wherein said substrate has an adhesive layer on the side opposite the image receiving layer side, and also has a release sheet having a release coating containing a release agent on said adhesive layer, where said release sheet is laminated to the adhesive layer on its release coating side.

9. A thermal transfer receiving sheet according to claim 2, wherein the adhesive used in said barrier layer comprises an aqueous polymer compound as a major component.

10. A thermal transfer receiving sheet according to claim 9, wherein said aqueous polymer compound is al least one selected from the group consisting of polyvinyl alcohol, ethylene-vinyl alcohol copolymer resins and ethylene-acrylic acid copolymer resins.

11. A thermal transfer receiving sheet according to claim 10, wherein said substrate has an adhesive layer on the side opposite the image receiving layer side, and also has a release sheet having a release coating containing a release agent on said adhesive layer, where said release sheet is laminated to the adhesive layer on its release coating side.

12. A thermal transfer receiving sheet according to claim 2, wherein said substrate has an adhesive layer on the side opposite the image receiving layer side, and also has a release sheet having a release coating containing a release agent on said adhesive layer, where said release sheet is laminated to the adhesive layer on its release coating side.

13. A thermal transfer receiving sheet according to claim 1, wherein the adhesive used in said barrier layer comprises an aqueous polymer compound as a major component.

14. A thermal transfer receiving sheet according to claim 13, wherein said aqueous polymer compound is al least one selected from the group consisting of polyvinyl alcohol, ethylene-vinyl alcohol copolymer resins and ethylene-acrylic acid copolymer resins.

15. A thermal transfer receiving sheet according to claim 14, wherein said substrate has an adhesive layer on the side opposite the image receiving layer side, and also has a release sheet having a release coating containing a release agent on said adhesive layer, where said release sheet is laminated to the adhesive layer on its release coating side.

16. A thermal transfer receiving sheet according to claim 1, wherein said substrate has an adhesive layer on the side opposite the image receiving layer side, and also has a release sheet having a release coating containing a release agent on said adhesive layer, where said release sheet is laminated to the adhesive layer on its release coating side.

* * * * *